US007082187B2

(12) United States Patent
De Groot

(10) Patent No.: US 7,082,187 B2
(45) Date of Patent: Jul. 25, 2006

(54) RADIOLOGICAL IMAGE DETECTION SYSTEM FOR A SCANNING X-RAY GENERATOR

(75) Inventor: Paul De Groot, St. Ismier (FR)

(73) Assignee: Thales Electron Devices S.A., Velizy (FR)

( * ) Notice: Subject to any disclaimer, the term of this patent is extended or adjusted under 35 U.S.C. 154(b) by 0 days.

(21) Appl. No.: 11/124,268

(22) Filed: May 9, 2005

(65) Prior Publication Data

US 2005/0201518 A1 Sep. 15, 2005

Related U.S. Application Data

(63) Continuation of application No. 10/129,818, filed on May 9, 2002, now Pat. No. 6,934,360.

(30) Foreign Application Priority Data

Dec. 30, 1999 (FR) ..... 99 16778

(51) Int. Cl.
*H05G 1/64* (2006.01)

(52) U.S. Cl. ..... 378/98.3; 378/98.6

(58) Field of Classification Search ..... 378/62, 378/98.3, 146, 196, 197, 98.8, 98, 98.6, 98.2; 250/370.11; 382/174–178
See application file for complete search history.

(56) References Cited

U.S. PATENT DOCUMENTS

| | | | | |
|---|---|---|---|---|
| 4,404,591 A | | 9/1983 | Bonar | 378/98.2 |
| 5,050,199 A | | 9/1991 | Watanabe | 378/146 |
| 5,162,919 A | | 11/1992 | Ono | 358/302 |
| 5,434,418 A | * | 7/1995 | Schick | 250/370.11 |
| 6,215,848 B1 | | 4/2001 | Linders et al. | 378/98.12 |
| 6,876,722 B1 | * | 4/2005 | Suzuki et al. | 378/57 |

FOREIGN PATENT DOCUMENTS

| | | |
|---|---|---|
| EP | 0 140 695 | 5/1985 |
| EP | 0 312 850 | 4/1989 |
| EP | 0 402 876 | 12/1990 |
| EP | 0 967 655 | 12/1999 |
| JP | 0 083 465 | 7/1983 |
| JP | 11 274446 | 10/1999 |
| WO | 94 30004 | 12/1994 |

* cited by examiner

*Primary Examiner*—Edward J. Glick
*Assistant Examiner*—Jurie Yun
(74) *Attorney, Agent, or Firm*—Oblon, Spivak, McClelland, Maier & Neustadt, P.C.

(57) ABSTRACT

The invention involves a radiological image detection system capable of cooperating with a scanning X-ray generator designed to produce X-ray radiation scanning a surface to be imaged. The scanning X-ray radiation irradiates, portion after portion, the surface to be imaged. The X-ray radiation from a portion carries a radiological image of the portion. The detection system comprises an image sensor which is stationary with respect to the scanning and which is dimensioned so as to be able to acquire an image of the surface to be imaged by the X-ray radiation from the portion. In addition, it comprises a device for limiting, at a given time, the acquisition of the image sensor to that of the image of the portion irradiated at that time.

10 Claims, 9 Drawing Sheets

RADIOLOGICAL IMAGE DETECTION SYSTEM FOR A SCANNING X-RAY GENERATOR

CROSS-REFERENCE TO RELATED APPLICATIONS

Figure 1:
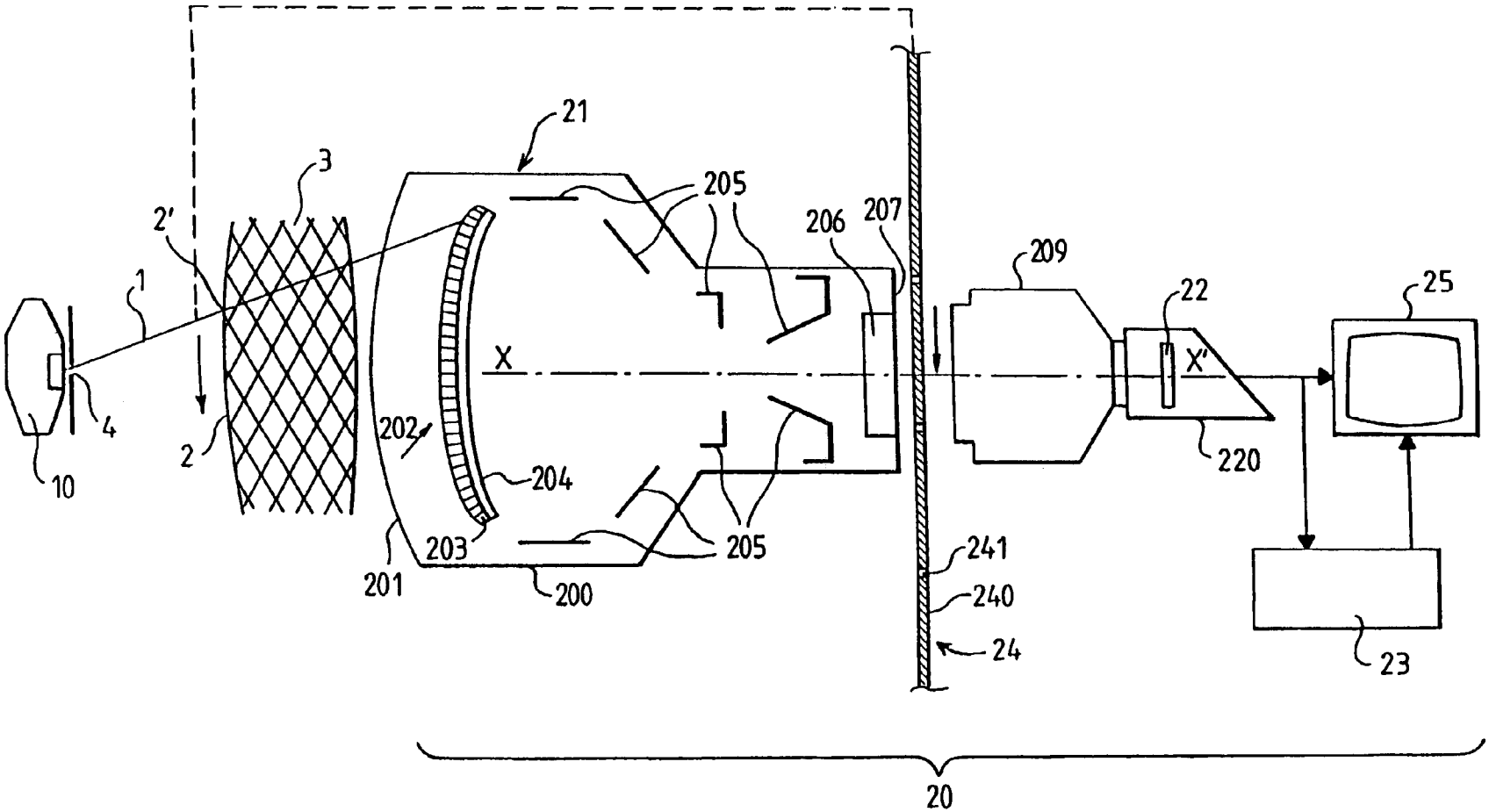

This application is a continuation of and is based upon and claims the benefit of priority under 35 U.S.C. § 120 of U.S. application Ser. No. 10/129,818 (now U.S. Pat. No. 6,934, 360) filed on May 9, 2002, and PCT/FR00/03723, filed on Dec. 28, 2000, and under 35 U.S.C. § 119 of French application no. 99/16778 filed on Dec. 30, 1999.

The present invention relates to a radiological image detection system for a scanning X-ray generator capable of operating at a high rate.

X-ray imaging systems, bringing together a radiological image detection system combined with an X-ray generator, are used in the medical field or in the field of nondestructive inspection. In these types of application, it is desired to obtain images which are of very high quality and especially well contrasted.

A conventional X-ray imaging system used in the medical field generally comprises an X-ray generator delivering X-ray radiation to which a patient is exposed and, away from the X-ray generator, a detection system which detects the X-ray radiation having passed through the patient and which then carries a radiological image. The X-ray generator and the patient are positioned one with respect to the other so that the irradiation field of the X-ray radiation covers, at a given time, the entire surface to be imaged of the patient. The stationary detection system then simultaneously detects the radiological image of the entire surface to be imaged.

However, a significant part of the X-rays which passes through the patient is scattered, that is to say that it is deflected from its initial rectilinear trajectory. All the same, the deflected or scattered rays are detected by the detection system and the detected image is degraded with respect to that which would be supplied solely by the useful X-rays, that is to say those which have not been deflected. This degradation results in a loss of contrast.

To eliminate the scattered X-rays, in general, an antiscatter grid is placed between the patient and the detection system. This grid absorbs a large part of the scattered X-rays but also absorbs part of the useful X-rays, and consequently requires a higher patient dose. This grid is currently the only solution for removing the scattering from the detection systems with an X-ray image intensifier tube which are currently the most widely used in order to carry out radiological imaging in real time.

Another solution for eliminating the scattered X-rays without increasing the X-ray dose consists in using a scanning X-ray generator which progressively irradiates the surface to be imaged, the instantaneous irradiated area being only a portion of the surface to be imaged.

In this case, the X-ray generator is combined with a movable detection system which is synchronized with the scanning movement of the X-ray radiation and in geometrical correspondence with the instantaneous irradiated area. The detection system is generally formed from solid-state sensor elements covered with a scintillating material and arranged in a linear array, the dimensions of this linear array are such that it only receives the image from the instantaneous irradiated area. It therefore does not detect the scattered X-rays which are deflected but only X-rays having passed directly through the patient.

However, the implementation of such detection systems requires complicated mechanical devices.

The dimensions of the linear array are conditioned by those of the instantaneous irradiated area. It is therefore not possible, without changing the linear array, to wish to optimize the compromise between the dimensions of the irradiated area and the X-ray output.

It is not easy to move the linear array of solid-state sensor elements in time with the scanning X-ray radiation, especially if the scanning speed required is high, as in the fluoroscopy examinations in which several tens of images per second must be produced.

The precision mechanism used to move the detection system represents a large item in the cost of such detection systems.

Detection systems in which a slot in a mechanical shutter is moved at the level of the detector, in synchronism with the scanning executed by the X-ray beam, have also been proposed. These mechanical systems do not allow a high scanning rate and are heavy and expensive. Patent EP 0 083 465 gives an example thereof.

The present invention, while continuing to remove the scattering from the radiological images, aims to overcome the aforementioned problems, especially those linked to the doses to be administered to the patient, to the mechanical movement of the image sensor or of other parts such as slots in the shutters on the detection side; it makes it possible to reach scanning speeds compatible with those required in the fluoroscopy mode.

In order to achieve this, the present invention proposes a radiological image detection system capable of cooperating with a scanning X-ray generator designed to produce X-ray radiation scanning a surface to be imaged, this X-ray radiation irradiating, portion after portion, the surface to be imaged, the X-ray radiation from a portion carrying a radiological image of said portion. The system comprises an image sensor which is stationary with respect to the scanning and which is dimensioned so as to be able to acquire an image of the entire surface to be imaged by the X-ray radiation from the portions, the detection system in addition comprising means for electronically limiting, at a given time, the acquisition of the image sensor to that of the image of the portion irradiated at that time, these electronic limitation means being in synchronism with the scanning and in geometrical correspondence with the irradiated portion.

The electronic limitation means are purely static unlike the rotating or moving mechanical limitation means of the prior art.

In a first configuration, the means for limiting the acquisition of the image sensor may be means of partially occluding the image sensor with respect to the surface to be imaged, external to the image sensor. A liquid-crystal screen, the scanning of which is controlled in synchronism with the scanning of the X-ray beam, allows only a limited image area corresponding to that which is illuminated at that time by the detector to be let through toward a detection camera.

The image sensor may be a light image sensor and may cooperate with means for converting the X-ray radiation from the portions into a light image.

In another embodiment, the image sensor may be an electronic image sensor and cooperate with means for converting the X-ray radiation from the portions directly into an electronic image. The selenium sensors are capable of carrying out this direct conversion.

In both cases, the means for limiting the acquisition of the image sensor may be integrated with the image sensor, the latter being organized to prevent any image acquisition outside the area which corresponds to a portion of image illuminated at any time by the X-ray beam.

The image sensor may be of the solid-state type and especially of the CCD type or of the CMOS type, with photosensitive diodes or with capacitive elements.

The image sensor may be a light image sensor formed from a plurality of solid-state photosensitive pixels and the means for limiting the acquisition of the image sensor may control, just before a portion is irradiated, the erasure of the sensor pixels corresponding to the light image of said irradiated portion, and the reading of said pixels just after said portion is irradiated.

It is also possible that the light image sensor is of the photographic film or cinematographic film type; in this case, a liquid crystal screen will be used in principle to carry out the image limitation.

The means for converting the X-ray radiation into a light image may be of the X-ray image intensifier or scintillator type deposited on a photosensitive matrix in the solid state, while the means for converting the X-ray radiation into an electronic image may be selenium-based.

The detection system may comprise means for processing the image picked up by the image sensor so as to reconstruct a complete image of the radiological image of the surface to be imaged from the images of the irradiated areas.

Figure 2:
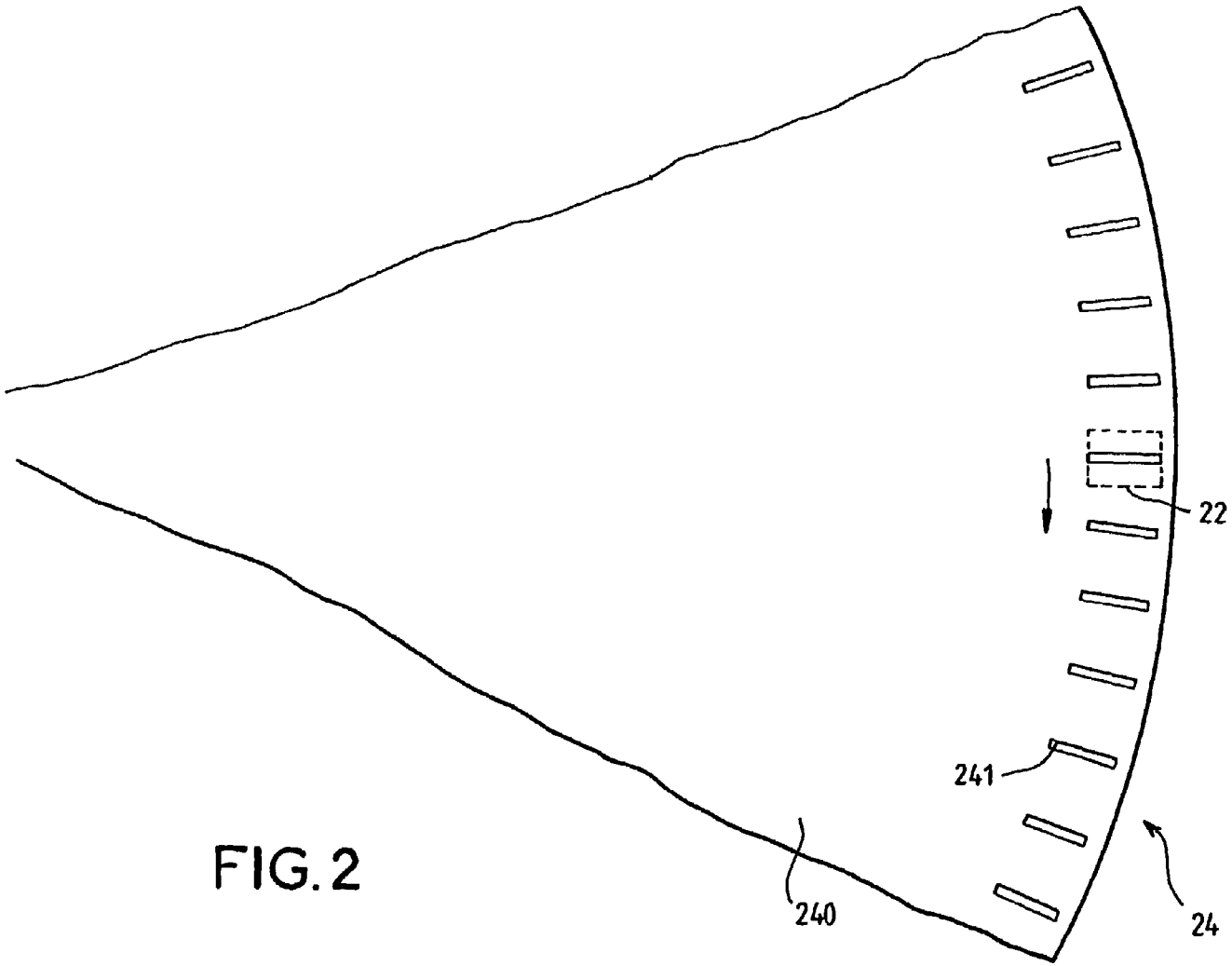
Figure 3:
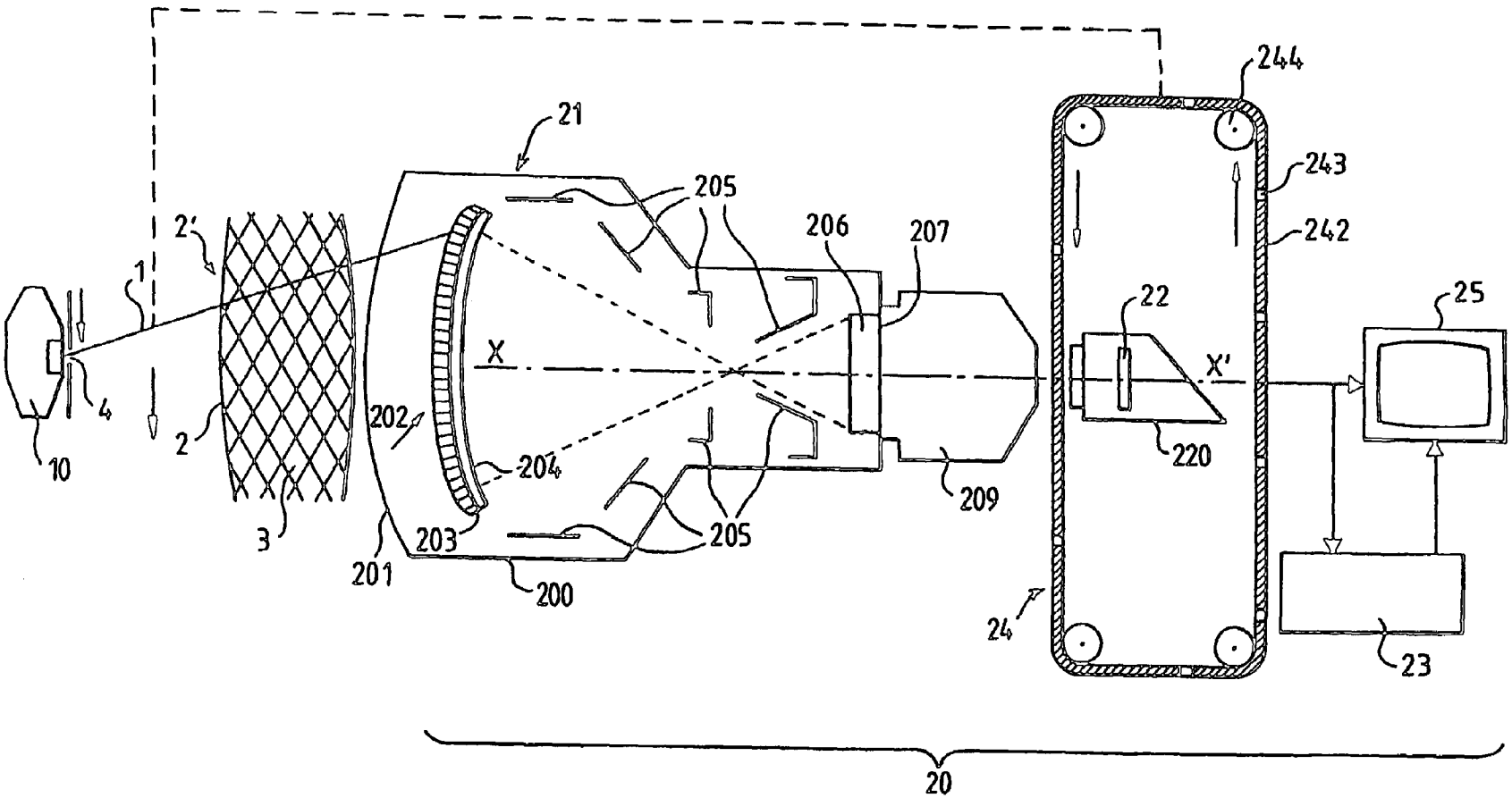
Figure 4:
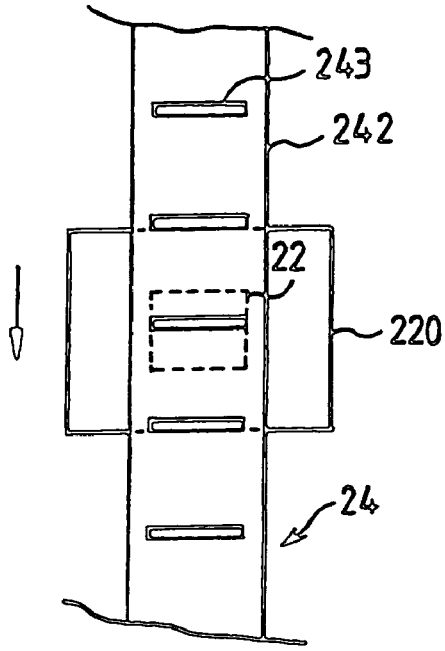
Figure 7:
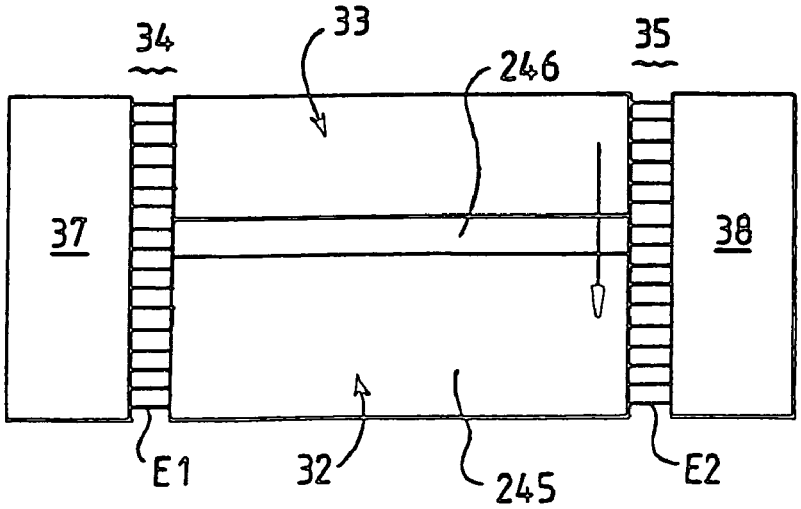
Figure 5:
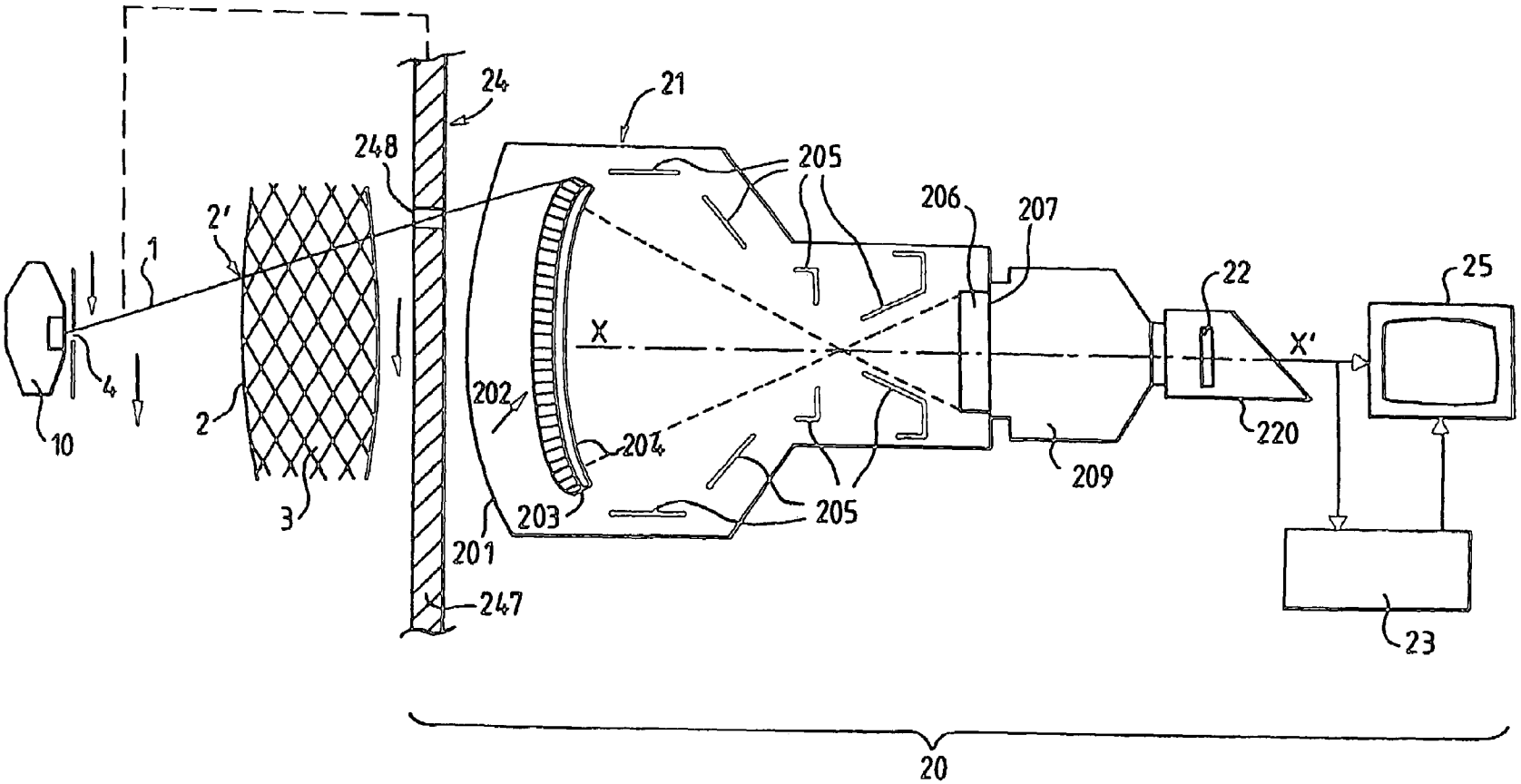
Figure 6:
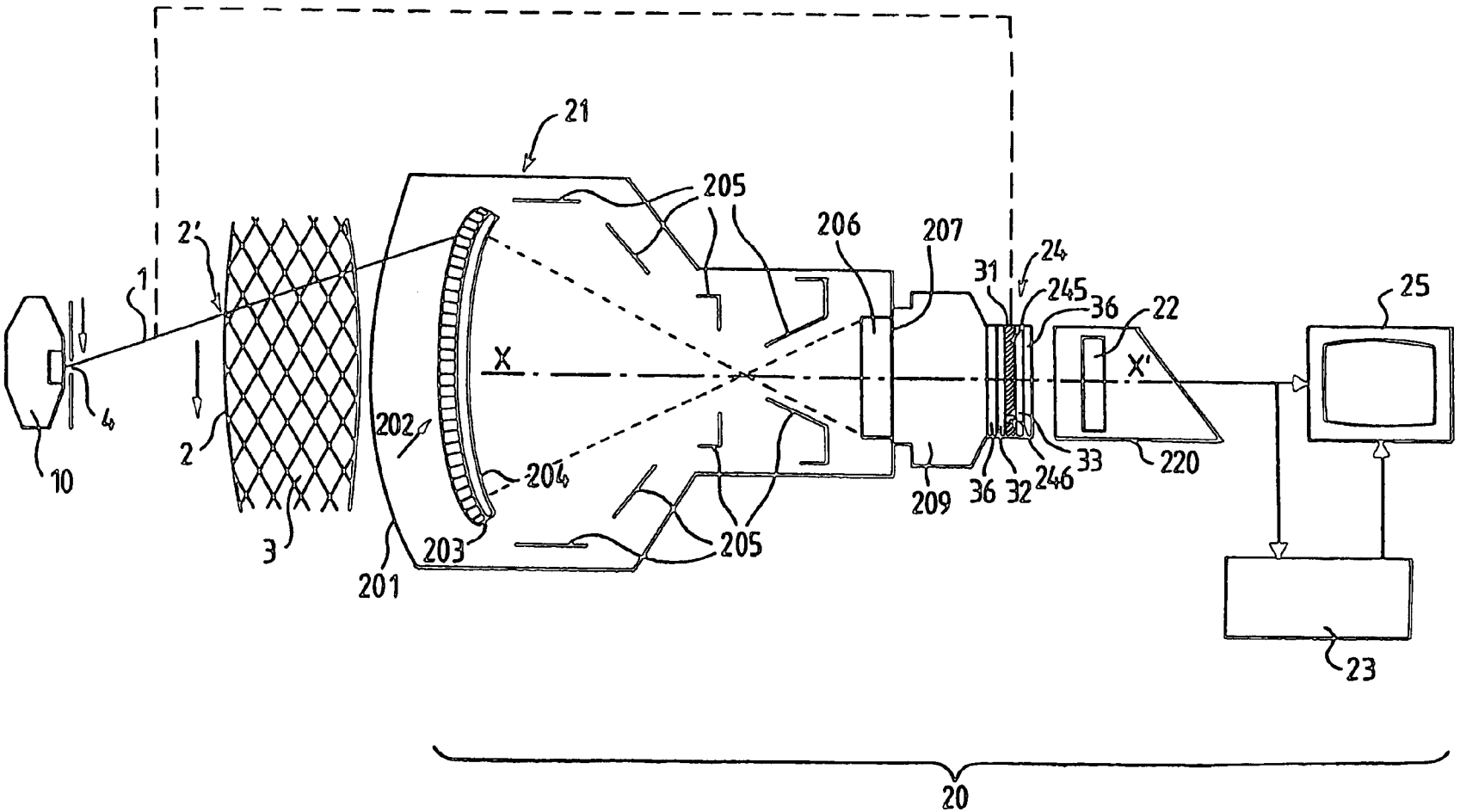
Figure 8A:
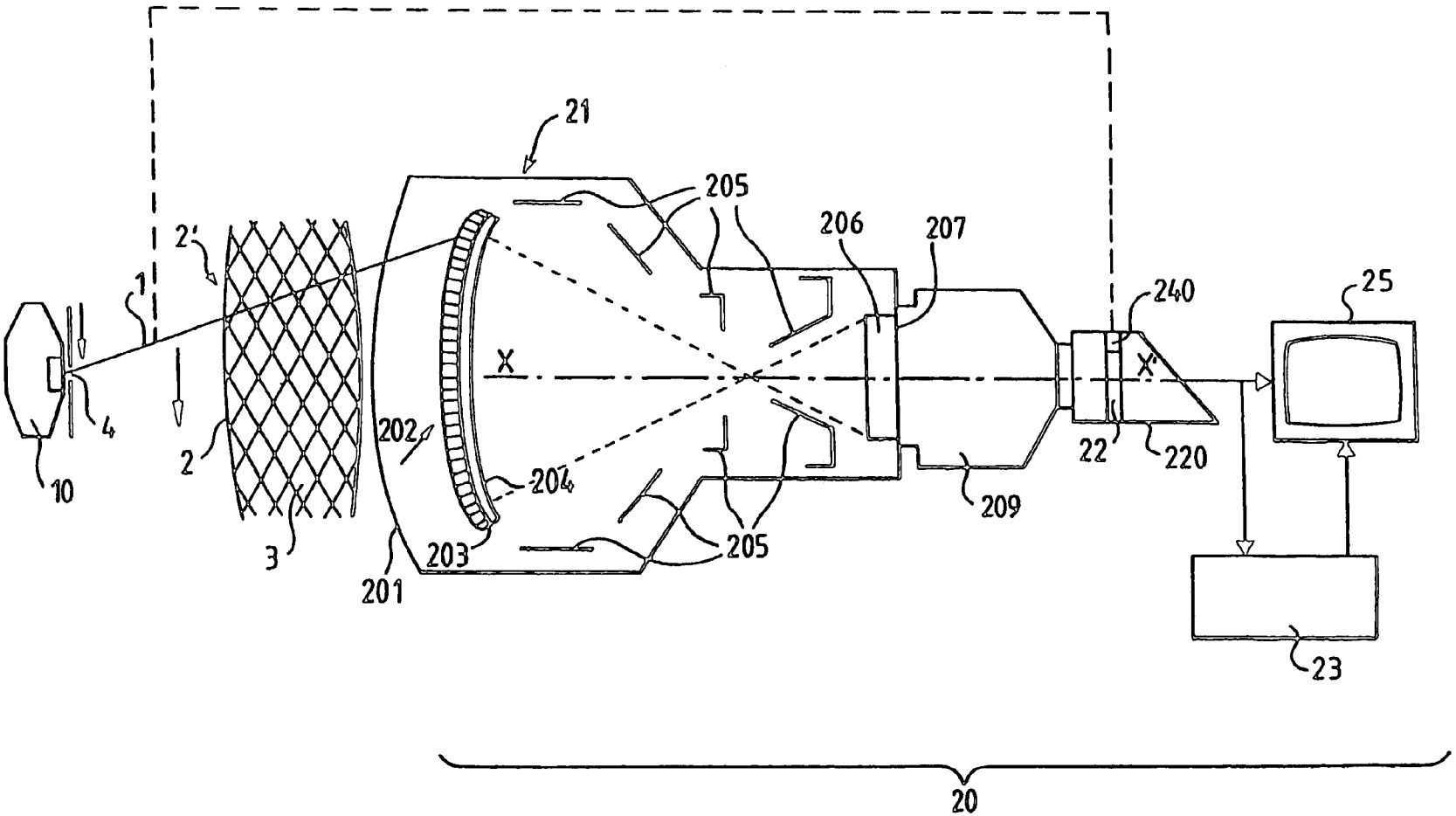
Figure 8B:
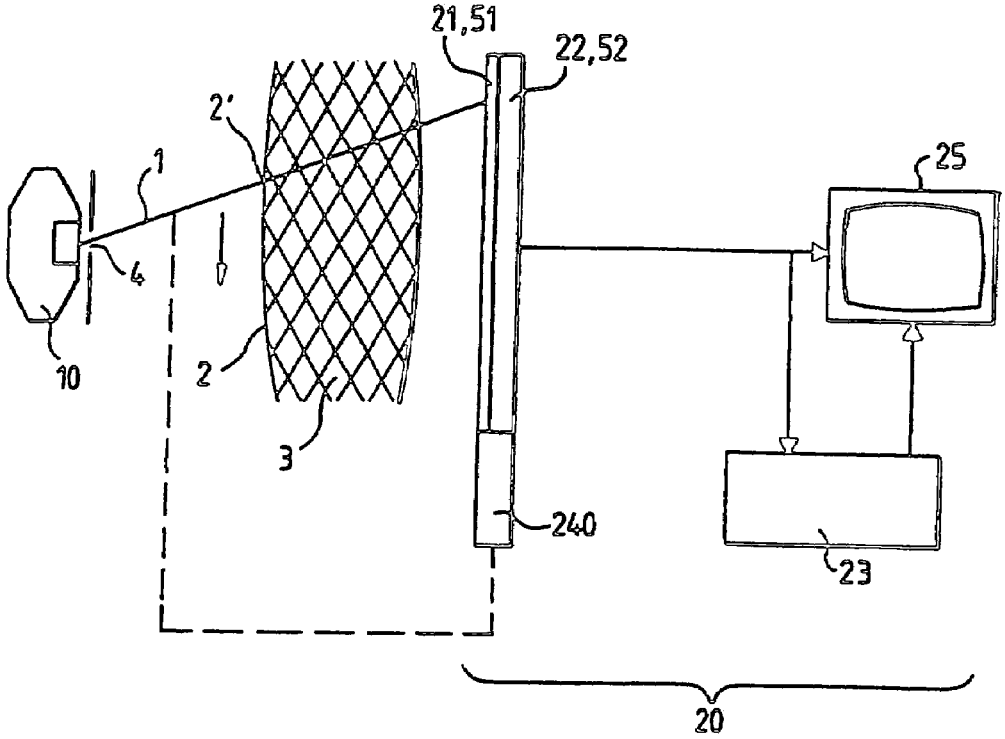
Figure 10:
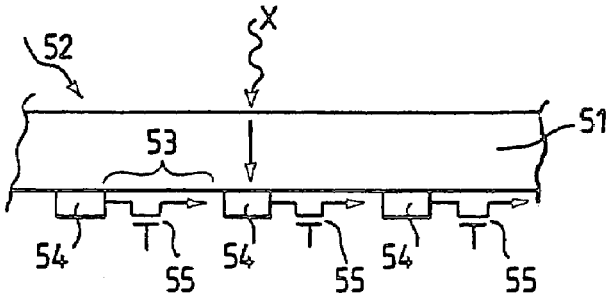
Figure 9A:
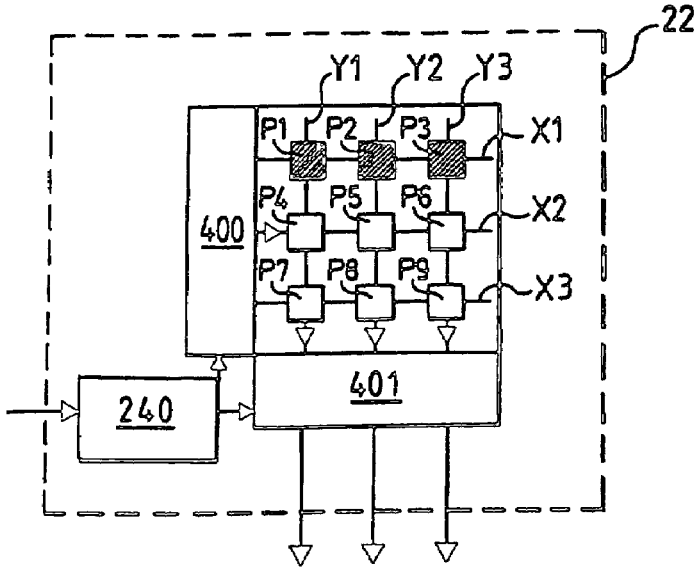
Figure 9B:
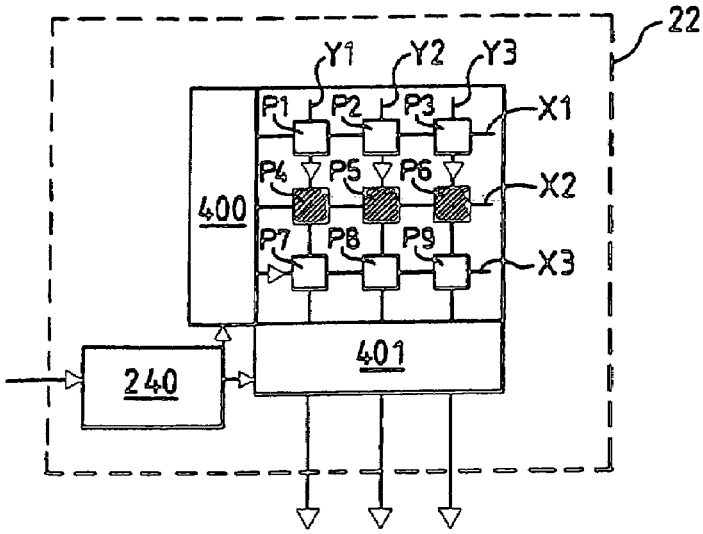
Figure 9C:
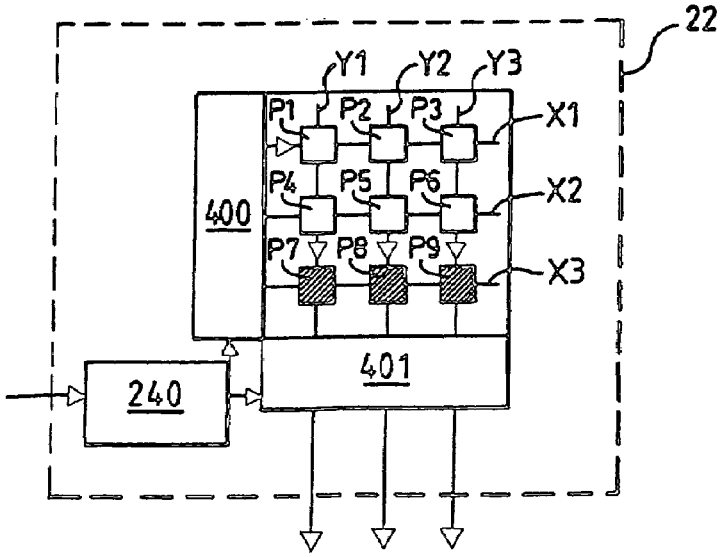

Other characteristics and advantages of the invention will become apparent on reading the following description illustrated by the appended figures which show:

FIG. 1, a section of an example of an image detection system combined with a scanning X-ray generator, in which the means of limiting the acquisition of the image sensor are mechanical partial occluding means;

FIG. 2, a front view of the means limiting the acquisition of the image sensor used in the image detection system of FIG. 1;

FIG. 3, a section of a second example of an image detection system combined with a scanning X-ray generator, in which the means of limiting the acquisition of the image sensor are mechanical partial occluding means;

FIG. 4, a front view of the means limiting the acquisition of the image sensor used in the image detection system of FIG. 3;

FIG. 5, a section of a third example of an image detection system combined with a scanning X-ray generator, in which the means of limiting the acquisition of the image sensor are mechanical partial occluding means;

FIG. 6, a section of a fourth example of an image detection system according to the invention combined with a scanning X-ray generator, in which the means of limiting the acquisition of the image sensor are electronic partial occluding means external to the image sensor;

FIG. 7, a front view of the partial occluding means used in the image detection system of FIG. 6;

FIGS. 8*a*, 8*b*, in section, two new examples of an image detection system according to the invention in which the means limiting the acquisition of the image sensor are integrated with the image sensor;

FIGS. 9*a*, 9*b*, 9*c*, three front views of the image sensor of FIG. 8*a*, at different times, enabling the operation of the means limiting its acquisition to be understood;

FIG. 10, in partial section, an electronic image sensor which can be integrated into an image detection system according to the invention.

In these figures, the same elements bear the same reference and the scales are not complied with for the sake of clarity.

FIG. 1 shows an image detection system 20. This image detection system is used in medical imaging equipment comprising a scanning X-ray generator 10 which delivers X-ray radiation 1 scanning a surface 2 to be imaged of a patient 3 to be examined. At a given time, the X-ray radiation 1 irradiates only a portion 2' of the surface 2 to be imaged. At the end of a complete scan, the entire surface 2 to be imaged has been irradiated portion by portion. The scanning X-ray generator 10 may be with slot scanning, that is to say with a slot which moves in front of an X-ray source or be with a fixed slot as described, for example, in French Patent Application FR A-2 795 864. In this case, the angle of incidence of the X-ray beam on the body to be irradiated is made to vary by acting on the variable orientation of the electron beam with respect to a target: the scanning speed may be high, in the absence of movements of mechanical parts.

The detection system 20 is on the other side of the patient 3, that is to say away from the scanning X-ray generator 10. It detects the X-ray radiation 1 having passed through the patient, this X-ray radiation carrying a radiological image.

The image detection system 20 comprises an image sensor 22 intended to acquire, via the X-ray radiation from the portions, an image of the surface to be imaged. This image sensor 22 is stationary with respect to the scanning and it has dimensions enabling it to acquire an image of the entire surface 2 to be imaged. It is not made to move or limited in dimensions to those of the irradiated portion. By dispensing with the means for making the sensor move, since it is stationary, in particular the mechanical problems encountered with a sensor which can be moved in time with the scanning radiation are eliminated.

The image detection system 20 also comprises means 24 for limiting, at a given time, the acquisition of the image sensor 22 essentially to that of the image of the portion 21 irradiated at that time, these means being in synchronism with the scanning and in geometrical correspondence with the irradiated portion 2'. A link in dotted lines illustrates the synchronism between the scanning X-ray radiation 1 and the means 24 limiting the acquisition of the image sensor 22.

In the example described, the image sensor 22 is a light image sensor and it cooperates with means 21 for converting the X-ray radiation carrying the radiological image into a light image received by the light image sensor 22.

It would be possible to envision using an electronic image sensor in the place of the light image sensor, as shown in FIG. 10 described below. This sensor is intended to pick up electronic charges and it cooperates with means for directly converting the X-ray radiation carrying the radiological image into an electronic image.

In the example described in FIG. 1, the detection system 20 comprises an X-ray image intensifier tube 21 known by the acronym XRII, followed by the light image sensor 22, as a conversion means.

The means 24 limiting the acquisition of the light image sensor 22 are mechanical means for partial occluding of the light image sensor 22. These partial occluding means 24 are external to the light image sensor 22, they partially mask the image sensor 22 so that it only picks up, at a given time, the light image of the portion 2' irradiated by the scanning X-ray radiation 1.

The image detection system will now be seen in further detail in its embodiment of FIG. 1.

The XRII tube 21 conventionally comprises an evacuated sealed chamber 200 closed at one end by an entry window 201 through which the scanning X-ray radiation 1 enters, having passed through the patient 3.

The scanning X-ray radiation 1 then encounters an input screen 202, the function of which is to translate the intensity of the X-ray radiation into a number of electrons. This input screen 202 is dimensioned so that the X-ray radiation 1 can strike it whatever the location of impact on the entry window 201. The input screen 202 generally comprises a scintillator 203 combined with a photocathode 204. The scintillator 203 converts the scanning X-ray radiation 1 into visible photons which are themselves converted into electrons by the photocathode 204.

A set of electrodes 205 accelerates the electrons and focuses them on a cathodoluminescent output screen 206. The luminescent output screen 206 is placed close to an exit window 207 located away from the entry window 201. The impact of the electrons on the luminescent screen 206 makes it possible to reconstruct the light image which has formed on the photocathode 204. This light image is the result of the radiological image of the irradiated portion 2' at a given time.

This light image comprises the faults mentioned above, since with only the scanning X-ray radiation, scattered X-rays hit the photocathode 204 and their effect is visible on the output screen 206.

The image displayed by the output screen 206 is then transmitted to the light image sensor 22. This light image sensor 22 is generally a sensor of the CCD (Charge-Coupled Device) type included in a video camera 220, a cinematographic film placed in a cinematographic camera or a photographic film included in a photographic apparatus. The CCD sensor may be advantageously replaced by a sensor of the CMOS type which operates in a very similar way.

The light image displayed by the output screen 206 is transmitted toward the light image sensor 22 generally via an optical coupling device 209, placed outside the XRII tube 21 and centered on a longitudinal axis XX' of the XRII tube, an axis around which the output screen 206 is also centered. This optical coupling device 209 may comprise lenses and/or optical fibers, etc.

The light image sensor 22 is dimensioned so as to receive the entire image of the surface 2 to be imaged, as is in the case in the conventional image detection systems with a stationary X-ray beam.

It is combined with partial occluding means 24 synchronized with the scanning movement of the scanning X-ray radiation 1 and in geometrical correspondence with the irradiated portion 2' of the surface to be imaged. By being partially masked, the light image sensor 22 is only able to pick up the light image of the portion 2' irradiated by the scanning X-ray radiation 1. These occluding means 24 prevent the light image sensor 22 from picking up the trace of X-rays scattered in the patient 3.

The image detection system 20 may comprise a signal acquisition and processing device 23 which processes and stores signals relating to the image delivered to it by the light image sensor 22. After suitable processing, these signals can be observed on a viewing device 25.

In the example of FIG. 1, the light image sensor 22 is stationary with respect to the scanning while the partial occluding means 24 are moving and more particularly rotating with respect to the light image sensor 22. They are placed between the output screen 206 and the light image sensor 22.

They take the form of a disk 240 opaque to the light coming from the output screen 206, and provided with at least one window 241 letting the light pass. This window 241 may be quite simply an opening in the disk which allows the light image of the irradiated portion 2' to pass.

The disk 240 is rotated so that its window 241 moves in synchronism with the X-ray radiation 1 scanning the surface 2 to be imaged. When the scanning X-ray radiation 1 has completely swept the surface 2 to be imaged, the window 241 has swept the light image sensor and the latter has picked up the entire radiological image of the surface 2 to be imaged converted into a light image, from a plurality of light images corresponding to the various portions 2' irradiated during the scanning. The rate of rotation of the disk 240 is synchronized with that of the scanning X-ray beam 1.

It is assumed that the scanning X-ray radiation 1 scans the surface 2 to be imaged from top to bottom, as shown in FIG. 1. The scanning X-ray radiation 1 emerges from a slot 4 whose length, perpendicular to the scanning direction, corresponds to the size of the surface 2 to be imaged, also located perpendicular to the scanning direction, to within a magnification coefficient. This factor is a function of the distance separating the patient 3 from the X-ray generator 10. The width of the slot 4 located in the direction of the scanning is very small compared to the other dimension of the surface 2 to be imaged also located in the scanning direction. The slot 4 perhaps incited to a to-and-fro movement in translation, but it is possible to envision using a disk undergoing a rotational movement and provided with one or more slots in order to eliminate this to-and-fro movement which is always difficult to carry out at high speed. In case the scanning is unidirectional.

The dimensions of the irradiated portion 2' at a given time are modeled on those of the slot 4 to within the magnification coefficient.

In the example of FIG. 1, the windows 241 are radial slots, the dimensions of which are modeled on those of the irradiated portion 2', to within a proportionality coefficient, which is a function of the relative positions and of the effects of the various elements located between the patient 3 and the occluding means 24.

These slots 241 are located at the periphery of the disk 240. It is preferable to distribute the windows 241 over the entire periphery of the disk, especially if the rate of the radiological images to be taken is high.

Where the scanning is carried out in translation, the disk 240 will have a radius which is high compared to the length of the windows 241 such that the movement of a slot in front of the light image sensor 22 is likened to a translation. Reference can be made to FIG. 2.

The partial occluding means 24 may take the shape of an opaque strip 242 provided with one or more windows 243 transparent to light from the output screen 206. This strip 242 may be configured in a loop and driven by rollers 244 as illustrated in FIG. 3. When it faces the light image sensor 22, it moves in translation. Its windows 243 are slots which are transverse to the direction of movement of the strip 242. Reference may be made to FIG. 4.

If the scanning movement is a two-directional to-and-fro movement, the emission of the X-rays may be stopped during one of the two paths if the partial occluding means undergo a unidirectional rotational or translational movement.

In the two configurations described, the partial occluding means 24 are placed between the output screen 206 and the light image sensor 22. Where an optical coupling device 209 is inserted between the output screen 206 and the light image sensor 22, the partial occluding means 24 may be either between the output screen 206 and the optical coupling device 209, as in FIG. 1, or between the optical coupling device 209 and the light image sensor 22, as in FIG. 3.

It would also be possible to envision that the partial occluding means 24 are placed between the patient 3 and the conversion means 21 and that they are directly exposed to the X-ray radiation. In this variant, the image sensor could be an electronic image sensor.

In the example illustrated in FIG. 5, the image sensor is a light image sensor and the conversion means 21 are physically embodied by an XRII tube. The differences with the configurations previously described are that now the partial occluding means 24 are directly exposed to the X-ray radiation 1 having passed through the patient 3 and comprise a part 247 opaque to the X-ray radiation and one or more parts 248 which allows it to pass. It is assumed in this FIG. 5 that the partial occluding means 24 take the form of a disk which forms the opaque part 247 and that this disk is provided with windows 248 in the form of slots which allow the radiological image to pass from the irradiated portion 2'. These partial occluding means 24, which have to be partially opaque to the X-ray radiation, are lead-based and require means which are more powerful in order to be moved and which are more expensive than in the previous variants.

The previous examples make clear the principles of establishing the correspondence of a part of a body, irradiated at a given time by the X-ray beam which scans the body, with a corresponding part of a light image and with a corresponding part of an electronic image, or even directly with a corresponding part of an electronic image when the system directly converts the X-rays into an electronic image without passing through the light image stage. However, these examples also show that this correspondence is established by mechanical means, essentially in the form of slots which move in synchronism with the scanning of the X-ray beam.

The present invention proposes using electronic means, synchronized with the scanning movement of the X-ray beam, in order to produce an electronic image only in an area which, at a given moment, corresponding to the area irradiated by the X-ray beam with a scanning movement. These means are static and advantageously replace the mechanical means described above, in the various configurations envisioned.

Two main embodiments are provided.

In the first, which is applicable when a part of the sequence for converting the X-rays into an electronic image passes through a light image stage, a liquid crystal screen is inserted between the light image and an image sensor. This image sensor is preferably electronic (such as the CCD or CMOS matrix sensor of an electronic camera) but it is also possible to envision that it is a simple photographic film which will be exposed area by area as the X-ray scanning progresses, the areas of film not corresponding to the area irradiated at a given moment being masked at this moment. The liquid crystal screen is made opaque everywhere except in one area (in principle, a matrix row if the scanning allows irradiation row by row) corresponding to the image actually irradiated by the X-ray beam. The light image sensor, if it is electronic, does not collect any signal except in this area. The X-rays, which have been able to be scattered in various directions and which have been able to produce a light image not limited to the irradiated portion, will not affect the electronic sensor since the latter will only observe an area actually corresponding to the irradiated portion.

In the second major embodiment, which is applicable whether there is conversion into a light image before the image is collected by an electronic light image sensor or whether there is direct conversion of the X-rays into an electronic image, provision is made for the electronic integration means, which convert the light image photons or the X-ray image photons into electrons, to be organized in order to prevent the integration or the reading of charges outside the image area corresponding to the area irradiated at a given time by the scanning X-ray beam.

Typically, if a row (or possibly a few rows) of the light image sensor or electronic sensor is irradiated at a given time, it is arranged that the charges in these rows are removed just before the irradiation starts (thus removing the charges from undesirable scattered radiation), the charges resulting solely from the irradiation of the irradiated area are integrated and these charges are read immediately after the irradiation time.

First of all, reference may be made to FIGS. 6 and 7 which illustrate the invention.

The partial occluding means 24 are produced by a shutter 245 with a liquid crystal array for which transmission is controlled by the position of the portion 2' irradiated by the scanning X-ray radiation 1. These partial occluding means 24 are used in order to stop the light from the output screen 206 of the X-ray image intensifier tube 21.

This shutter 245 may comprise a fine layer 31 of liquid crystals (for example of the twisted nematic type) sandwiched between two transparent plates 32, 33 sealed together, themselves placed between two crossed polarizers 36.

A shutter 245 of this sort operates as follows. At least one of the transparent plates is provided with an array of electrodes making it possible to apply an electric field to portions of the liquid crystal layer. It is for this reason that the shutter 245 is called a shutter array. By subjecting part of the liquid crystal layer to an electric field, it becomes opaque and stops the light which is coming from the output screen 206. This light is no longer able to reach the light image sensor 22. In the absence of an electric field, this part is transparent and allows the light from the output screen 206 to pass. This light may then reach the light image sensor 22.

In the example described and shown in detail in FIG. 7, an array 34, 35 of parallel transparent electrodes E1, E2 oriented transversely to the scanning direction of the X-ray radiation 1 is shown on each transparent plate 32, 33. One electrode E1 of one array 34 is matched to one electrode E2 of the other array 35 and two matched electrodes are mutually facing. Each array 34, 35 is connected to a control device 37, 38, respectively, making it possible to apply a suitable potential to its electrodes E1, E2 and therefore to subject the portion of liquid crystals located between two matched electrodes to a suitable electric field so as to make it opaque. The control of the voltages to be applied to the electrodes, carried out in synchronism with the scanning, makes it possible at each instant to include, in the shutter 245 made opaque, a transparent area 246 whose dimensions are such that the light image sensor 22 only picks up the radiological image of the irradiated portion 2'. The dimensions of the transparent area 246 are modeled on those of the irradiated portion 2' to within the proportionality coefficient.

The electrode patterns described in FIG. 7 are only nonlimiting examples and others can of course be envisioned in order to define that which has to remain opaque and that which has to become transparent. A conventional matrix pattern may be used, provided that the control means, in principle row by row, are organized so as to correspond with the type of X-ray scanning used.

A not inconsiderable advantage of the means for limiting the acquisition of the image sensor combined with an X-ray image intensifier tube, in the configuration where they are located between the output screen and the image sensor, is that these limitation means do not remove only the light from the X-ray radiation scattered in the patient, but also the light and the X-rays scattered over the entire path between them and the patient. In their absence, this light or this X-ray radiation would be picked up by the image sensor and the contrast would be reduced. The best gains in contrast are obtained by placing the limitation means as close as possible to the light image sensor.

Instead of being external to the image sensor, the means of limiting its acquisition may be integrated therein. In this second solution, it is the electronic image sensor which collects only a useful image area at a given time. These variants are illustrated in FIGS. 8*a,* 8*b,* 9*a* to 9*c* and 10 with solid-state image sensors.

Reference may be made to FIG. 8*a*. As in FIG. 1, it shows the scanning X-ray generator 10 which delivers the X-ray radiation 1 scanning the surface 2 to be imaged of a patient 3 to be examined. The detection system 20 according to the invention is on the other side of the patient 3 with a light image sensor 22. It comprises means 21 for converting the X-ray radiation from portions 2' into a light image of the XRII tube type combined with the light image sensor 22. Now, the light image sensor 22 is an electronic sensor of the CMOS type included, for example, in a video camera 220. The means 240 for limiting the acquisition of the light image sensor are integrated with the light image sensor. They may either prevent the image acquisition outside a given area (corresponding to the area irradiated by the X-ray beam) or set to zero the image acquired in a given area (one sensor row, for example, or a few rows) just before collecting a desired image in this area, and hereagain in synchronism with the scanning of the X-ray beam.

The sensors of the CMOS type of recent design are starting to be used. They are very promising since they consume much less than the CCD sensors, are much less bulky, offer new possibilities in the acquisition of portions of images, can operate at speeds greater than those of the CCD sensors and cost less. In a sensor of this sort, each pixel comprises not just a photosensor element, for example a photodiode, but also a CMOS transistor circuit with the function of amplifying reading making it possible to be able to read quickly the number of charges stored in each pixel which has been exposed to a light signal. Means for digitizing the signals stored by the pixels and used during reading are also found on the same substrate.

In the configuration of FIG. 8*a* and of FIGS. 9*a* to 9*c,* the light image sensor 22 is formed from a plurality of sensitive points or photosensitive pixels P1 to P9 arranged in a matrix and connected between a column conductor Y1 to Y3 and a row conductor X1 to X3. These pixels are symbolized by a square. Only nine of them have been shown in order not to overload the figure. After exposure to a light signal, the pixels P1 to P3 connected to the same row conductor X1 are addressed at the same time by an addressing device 400 connected to the conductors of row X1 to X3, the amount of light which they have received is read from each pixel, the data read for each pixel being transferred by the column conductors Y1 to Y3 into an analog-digital conversion device 401 operating in parallel in order to be digitized therein.

The means 240 limiting the acquisition of the image sensor 22, in a first phase, just before portion 2' is irradiated, control the setting to zero, that is to say the erasure of the pixels P4 to P6 of the sensor corresponding to the light image of said portion, and in a second phase, just after the portion 2' has been irradiated, control the reading of the pixels P4 to P6 corresponding to this light image. In order to acquire the light image of the surface 2 to be imaged, all the pixels are subjected to this succession of erasure, exposure and read states.

FIGS. 9*a* to 9*c* serve to describe the operation of the limiting means 240. It is assumed that the X-ray radiation 1 is scanned linearly as in FIG. 1 and that a row of pixels corresponds to an irradiated portion 2'. The arrow entering the block 240 symbolizing the limiting means indicates that these means are synchronized with the scanning movement of the X-ray radiation.

In FIG. 9*a,* the row conductor X2, to which the pixels P4 to P6 are connected, bears an arrow from the addressing device 400, which symbolizes that they have just been erased or set to zero. Any trace of prior exposure has been removed. The pixels P1 to P3 are themselves exposed and are shown in gray while the pixels P7 to P9 are read, which is symbolized by arrows on the column conductors Y1 to Y3 from pixels P7 to P9 and directed toward the analog-digital conversion device 401.

In FIG. 9*b,* the pixels P4 to P6 are gray, which means that they have just been exposed to illumination delivered by the X-ray image intensifier tube. The pixels P1 to P3 are read, which is symbolized by arrows on the column conductors Y1 to Y3 from the pixels P1 to P3 and directed toward the analog-digital conversion device 401. The pixels P7 to P9 are erased, which is symbolized by the arrow from the addressing device 400, and borne by the row conductor X3 to which items the pixels P7 to P9 are connected.

In FIG. 9*c,* it was desired to illustrate the fact that the pixels P4 to P6 are read at this time while the pixels P1 to P3 are erased and the pixels P7 to P9 are exposed. The same symbols as above have been used.

In this way, the signals read do not include scattering.

In FIG. 8*b,* as in FIG. 1, the scanning X-ray generator 10, which delivers the X-ray radiation 1 scanning the surface 2 to be imaged of a patient 3 to be examined, can be found. The detection system 20 according to the invention can be found on the other side of the patient 3. There is no XRII tube. It comprises a solid-state image sensor 22, 52 which may be either of the light image sensor 22 type, or of the electronic image sensor 52 type. Its dimensions are substantially those of the surface 2 to be imaged. The sensor cooperates with means 21, 51 of converting the X-ray radiation from the portions 2' either into a light image or into an electronic image. If this involves conversion into a light image, the conversion means 21 are of the scintillator type which cover the light image sensor 22. If this involves conversion into an electronic image, the conversion means 51 are selenium-based, the selenium covering the electronic image sensor 52. The conversion means 21, 51 are directly facing the X-ray radiation which has passed through the patient. The light image sensor 22 may be a sensor whose pixels are formed formed from a photosensitive diode cooperating with an interrupter. This type of sensor is well known in digital radiology. The electronic image sensor 52 may be like the one shown in FIG. 10. The means 240 for limiting the acquisition of the image sensor are integrated with the image sensor 22, 52 and quite comparable to that which was described in FIG. 8*a* The sensitive elements of the sensor are subjected to a succession of states: erasure or setting to zero, exposure and reading.

With reference to FIG. 10, the electronic image sensor 52 is formed from a plurality of points 53 sensitive to the electronic charges, each one formed from a capacitive element 54 combined with a switching element 55, for example, a TFT (Thin Film Transistor) transistor activated especially during reading, arranged in an array as shown in FIG. 9. These sensitive points are produced especially using a technique for depositing thin films of semiconducting materials such as amorphous silicon. This electronic image sensor 52 cooperates with selenium-based radiological image-electronic image conversion means 51, for example. The sensitive points are covered with a selenium-based layer 51. On passing through the selenium-based layer 51, the X-ray radiation is directly converted into electronic charges, symbolized by an arrow. These electronic charges are stored in the capacitive elements 54. The means for limiting the acquisition of the electronic image sensor operate in a way which is comparable to that described for FIGS. 8*a* and 8*b*. The charges stored in the capacitive elements 54 are read sequentially, row by row. By carrying out an operation of setting the capacitive elements 54 of a row to zero just before they receive electronic charges and an operation of reading the charges stored in these capacitive elements just after they have received charges, the signal connected with the scattered X-rays is removed in the acquisition of the radiological image.

Instead of setting a row to zero before subjecting it to light irradiation or X-ray radiation, it would be possible to envision preventing the integration of the charges photogenerated outside a given row and to authorize it only in the selected row.

Finally, it should be indicated that, especially in the medical field, X-ray image intensifiers (vacuum tubes) are tending to be replaced by solid-state detectors, possibly of generous dimensions, and consequently that it is possible to adapt directly this solution for limiting the observation to a given area in correspondence and in synchronism with X-ray beam scanning.

The examples described are not limiting with regard to the choices of combination between the image sensor, the conversion means and the means limiting the acquisition of the image sensor, other combinations are possible without departing from the scope of the invention.

The invention claimed is:

1. A radiological image detection system, comprising:

a scanning X-ray generator configured to produce X-ray radiation scanning a surface to be imaged, said X-ray radiation successively irradiating a plurality of portions;

means for converting said X-ray radiation into a light image;

a stationary light image sensor placed behind said means for converting and configured to acquire an image of an entire surface to be imaged from the plurality of portions;

electronic shutter means interposed between said means for converting and said stationary light image sensor, said electronic shutter means being configured to limit, at a given time, acquisition of said stationary light image sensor to an area corresponding to an irradiated portion at the given time, and said electronic shutter means being further configured to act in synchronism with the X-ray radiation scanning and in geometrical correspondence with a portion irradiated by said X-ray radiation.

2. The radiological image detection system of claim 1, wherein:

said electronic shutter means includes a liquid crystal array.

3. The radiological image detection system of claim 2, wherein:

said stationary light image sensor comprises a plurality of solid-state photosensitive sensor pixels.

4. The radiological image detection system of claim 2, wherein:

said stationary light image sensor includes a plurality of capacitive elements.

5. The radiological image detection system of claim 2, wherein:

said means for converting the X-ray radiation includes an X-ray image intensifier or scintillator.

6. The radiological image detection system of claim 1, wherein:

said stationary light image sensor comprises a plurality of solid-state photosensitive sensor pixels.

7. The radiological image detection system of claim 1, wherein:

said stationary light image sensor includes a plurality of capacitive elements.

8. The radiological image detection system of claim 1, wherein:

said means for converting the X-ray radiation includes an X-ray image intensifier or scintillator.

9. A radiological image detection system, comprising:

an X-ray radiation converter configured to convert X-ray radiation scanning a surface to be imaged into a light image;

a stationary light image sensor placed behind said X-ray radiation converter and configured to acquire an image of a surface to be imaged from a plurality of portions of said surface to be imaged; and an electronic shutter means interposed between said X-ray radiation converter and said stationary light image sensor, said electronic shutter means being configured to limit, at a given time, acquisition of said stationary light image sensor to an area corresponding to an irradiated portion at the given time.

10. The radiological image detection system of claim 9, wherein:

said electronic shutter means includes a liquid crystal array; and said electronic shutter means is further configured to act in synchronism with the X-ray radiation scanning the surface to be imaged and in geometrical correspondence with a portion irradiated by said X-ray radiation.

* * * * *